US008196410B2

(12) United States Patent
Patel et al.

(10) Patent No.: US 8,196,410 B2
(45) Date of Patent: Jun. 12, 2012

(54) STRESS REDUCTION FEATURE TO IMPROVE FUEL NOZZLE SHEATH DURABILITY

(75) Inventors: Bhawan Patel, Mississauga (CA); Nagaraja Rudrapatna, Mississauga (CA)

(73) Assignee: Pratt & Whitney Canada Corp., Longueil, Québec (CA)

( * ) Notice: Subject to any disclaimer, the term of this patent is extended or adjusted under 35 U.S.C. 154(b) by 929 days.

(21) Appl. No.: 11/750,584

(22) Filed: May 18, 2007

(65) Prior Publication Data

US 2008/0286705 A1 Nov. 20, 2008

(51) Int. Cl.
*F02K 1/00* (2006.01)

(52) U.S. Cl. ..... 60/740

(58) Field of Classification Search ..... 60/740, 60/742, 746–748; 239/399, 403, 533.2
See application file for complete search history.

(56) References Cited

U.S. PATENT DOCUMENTS 2,698,050 A 12/1954 Bloomer et al.
2,780,061 A * 2/1957 Clarke et al. ..... 60/740
3,893,296 A 7/1975 Fredriksen
3,952,503 A 4/1976 Fox et al.
3,999,376 A 12/1976 Jeryan et al.
4,078,377 A 3/1978 Owens et al.
4,150,539 A 4/1979 Rubins et al.
4,322,945 A 4/1982 Peterson et al.
4,350,009 A 9/1982 Holzapfel
4,761,959 A * 8/1988 Romey et al. ..... 60/740
4,798,330 A 1/1989 Mancini et al.
5,239,831 A 8/1993 Kuroda et al.
5,269,468 A 12/1993 Adiutori
5,319,923 A 6/1994 Leonard et al.
5,335,490 A * 8/1994 Johnson et al. ..... 60/764
5,357,743 A 10/1994 Zarzalis et al.
5,396,761 A * 3/1995 Woltmann et al. ..... 60/39.827
5,396,763 A * 3/1995 Mayer et al. ..... 60/765
5,579,645 A 12/1996 Prociw et al.
5,598,696 A 2/1997 Stotts
6,497,105 B1 12/2002 Stastny
6,651,439 B2 11/2003 Al-Roub et al.
6,668,541 B2 * 12/2003 Rice et al. ..... 60/207
7,624,576 B2 * 12/2009 Alkabie et al. ..... 60/740

* cited by examiner

*Primary Examiner* — Louis Casaregola
*Assistant Examiner* — Phutthiwat Wongwian
(74) *Attorney, Agent, or Firm* — Norton Rose Canada LLP

(57) ABSTRACT

A fuel nozzle sheath has a lateral opening for admitting air about a nozzle stern. The stress distribution along the perimeter of the window is smoothed out by increasing the corner radius of the window corner presenting the highest stress concentration. The different corner radii of the window opening in the sheath allows to reduce stresses resulting from the load transferred from the combustor liner to the sheath.

14 Claims, 3 Drawing Sheets

STRESS REDUCTION FEATURE TO IMPROVE FUEL NOZZLE SHEATH DURABILITY

TECHNICAL FIELD

The invention relates generally to a fuel nozzle for gas turbine engines and, more particularly, addresses stress concentration in fuel nozzle sheaths.

BACKGROUND OF THE ART

In use, fuel nozzle sheaths are submitted to relatively severe stresses. This significantly impedes the service life of the nozzle sheaths. Stress concentration zones in the sheath may lead to sheath deformations. Large sheath deformation should be avoided to prevent load transfer from the combustion shell to the fuel nozzle stem via the nozzle sheath. Sheath deformations can also result in fretting damage on the fuel nozzle stem.

Accordingly, there is a need to provide a solution to the above mentioned problems.

SUMMARY

In one aspect, there is provided a fuel nozzle sheath adapted to be mounted about a gas turbine engine fuel nozzle stem having a spray tip, the sheath comprising a tubular body having a perimeter and extending longitudinally from a first end to an opposite second end, the first end being adapted to surround an inlet portion of the fuel nozzle stem while the second end surrounds the spray tip, and a lateral opening defined through the tubular body and extending longitudinally along at least a portion of said perimeter, said lateral opening having four corners, the radius of at least one of said corners being larger than the radii of the other corners.

In another aspect, there is provided a gas turbine engine fuel nozzle comprising: a fuel conveying member defining at least one fuel passage, a spray tip connected in fluid flow communication with said at least one fuel passage, said spray tip having an air discharged openings, a sheath provided about said fuel conveying member, an air passage defined between said fuel conveying member and said sheath, said air passage leading to said air discharged openings, a window defined in said sheath for supplying air to said air passage, said window being circumscribed by an edge having at least one corner presenting a stress concentration, and wherein said stress concentration is smoothed out by increasing a radius of curvature of said corner.

In a still further aspect, there is provided a method of smoothing out a stress distribution in a fuel nozzle sheath mounted about a fuel conveying member of a fuel nozzle, the fuel nozzle sheath defining a lateral window for supplying air about the fuel conveying member, the method comprising: reducing a stress concentration at a first corner of said window by increasing a corner radius of said first corner.

DETAILED DESCRIPTION OF THE PREFERRED EMBODIMENTS

Figure 1:
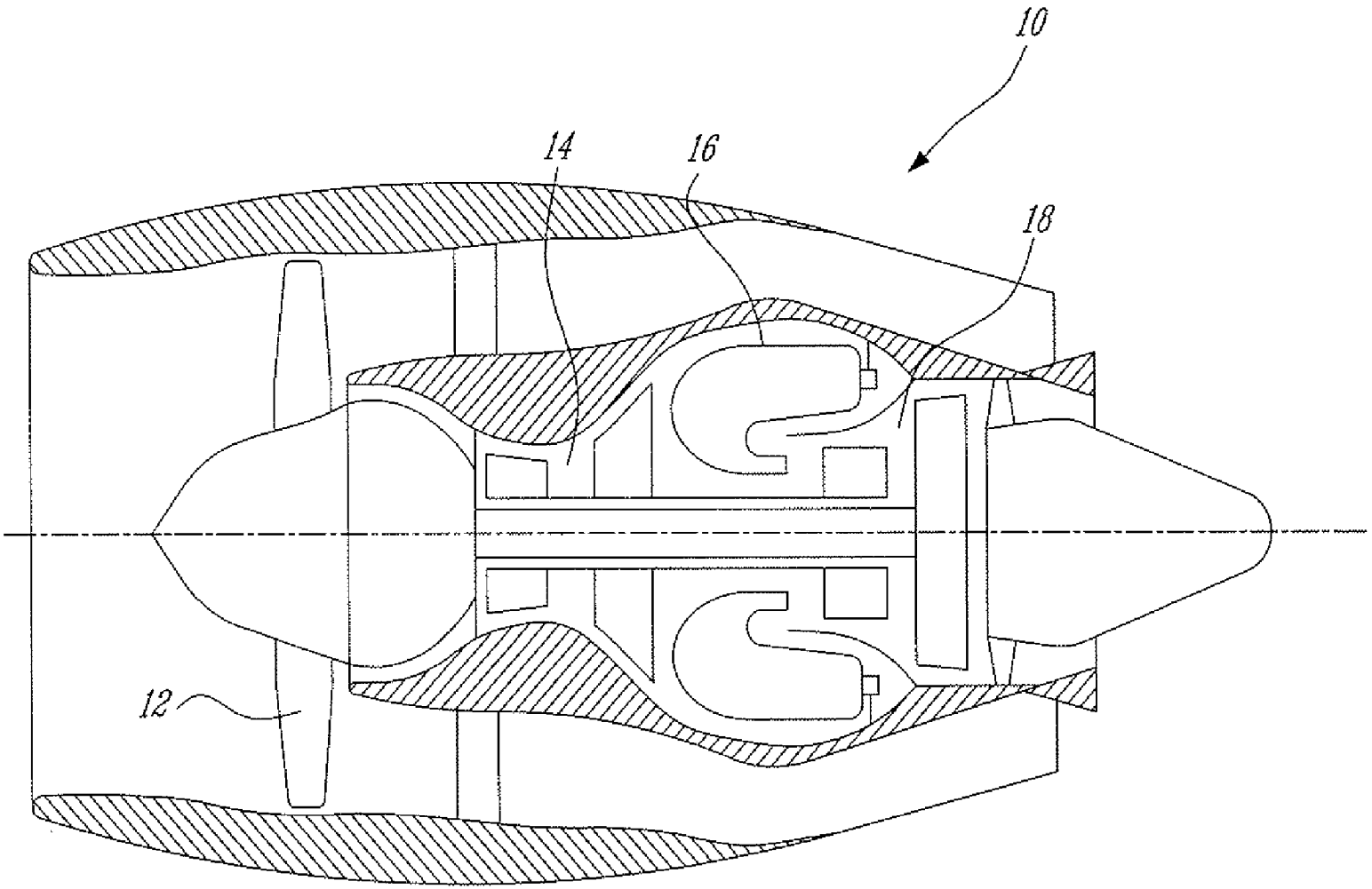
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The resulting high temperature combustion gases are used to turn the turbine section 18 and produce thrust when passed through a nozzle.

Figure 2:
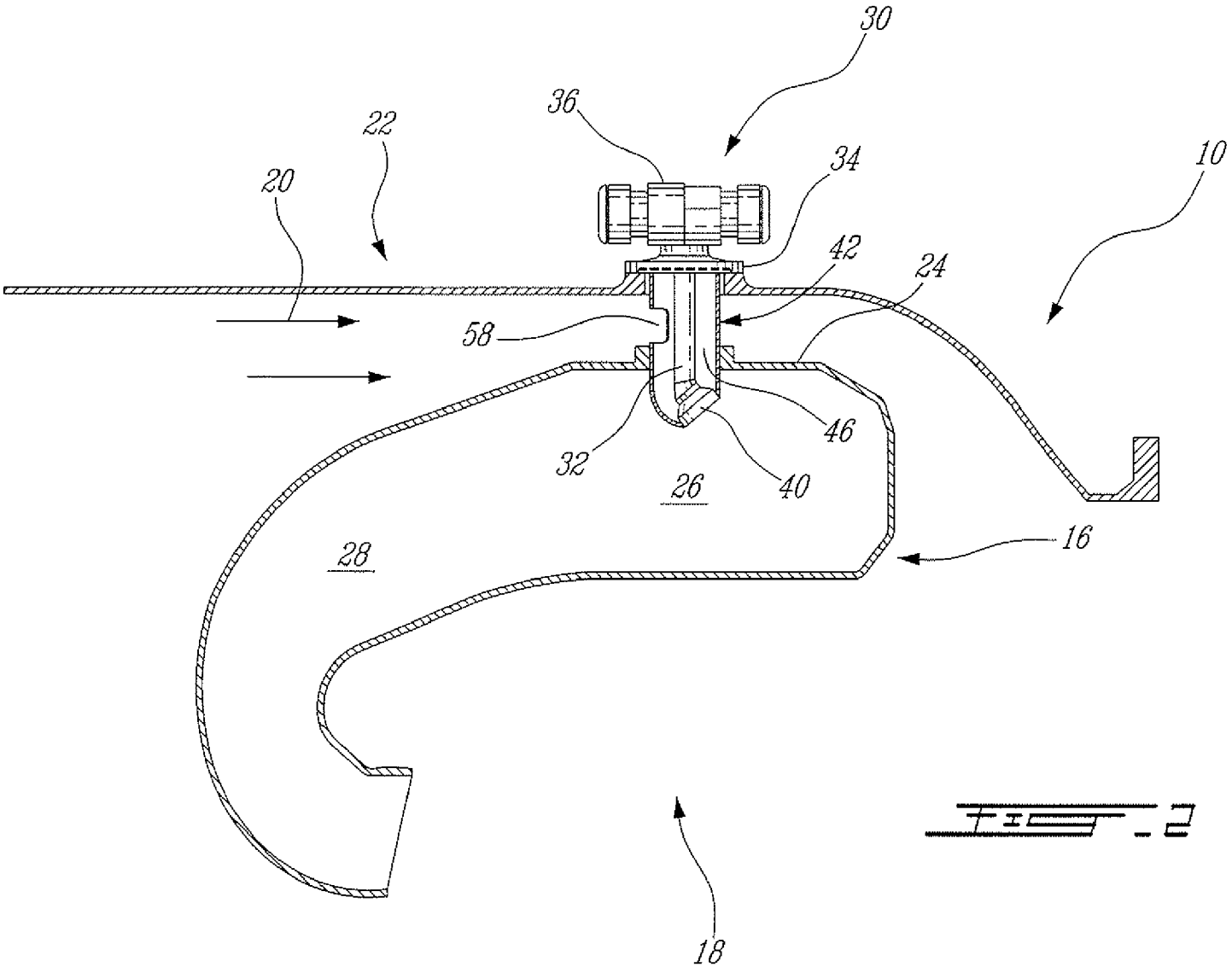
FIG. 2 is an axial cross-sectional view of a reverse flow combustor of the gas turbine engine showing a fuel nozzle.

Reference is now made to FIG. 2 of the drawings which illustrates one exemplary embodiment of the combustor 16. The combustor 16 shown is a reverse flow combustor 16, however it should be understood that other types of combustor, such as an axial flow combustor, may have also been exemplified. The combustor 16 is fixedly mounted by suitable means in an air flow path, designated generally by arrows 20, and receiving air from the compressor 14 or any other source of air. More particularly, the combustor 16 is mounted within the engine casing 22 which defines an annular or cylindrical flow path. The combustor 16 comprises an annular or cylindrical shell 24 which defines a primary combustion zone 26 and a dilution zone 28. Mounted to the engine casing walls 22 is a plurality of fuel nozzles 30, only one of which is shown in FIG. 2. The fuel nozzle 30 extends through the engine casing 22 and the combustor shell 24 such that it is in fluid flow communication with the primary combustion zone 26.

The fuel nozzle 30 exemplified in FIG. 2 comprises a fluid conveying member or stem 32 having a mounting flange 34. The stem 32 is adapted to be coupled at its inlet end to a fuel manifold adapter 36 and at its outlet end 38 to a spray tip assembly 40. Accordingly, the spray tip assembly 40 is coupled through the stem 32 to the fuel manifold adapter 36 which is connected to a fuel injector (not shown). The configuration of the stem 32 allows for the fuel supplied by the fuel injector to be directed from the fuel manifold 36 to the spray tip assembly 40. The fuel is then atomized by the spray tip assembly 40 for ignition in the primary combustion zone 26, as is well known in the art.

Figure 3:
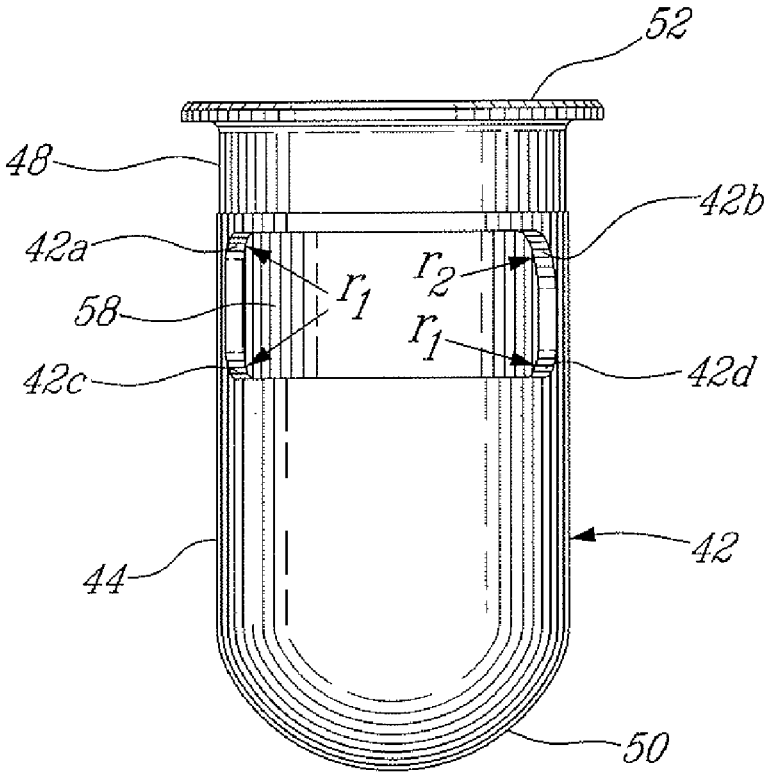
FIG. 3 is a front elevation view of a tubular sheath of the fuel nozzle, the sheath having a window with different corner radii.
Figure 4:
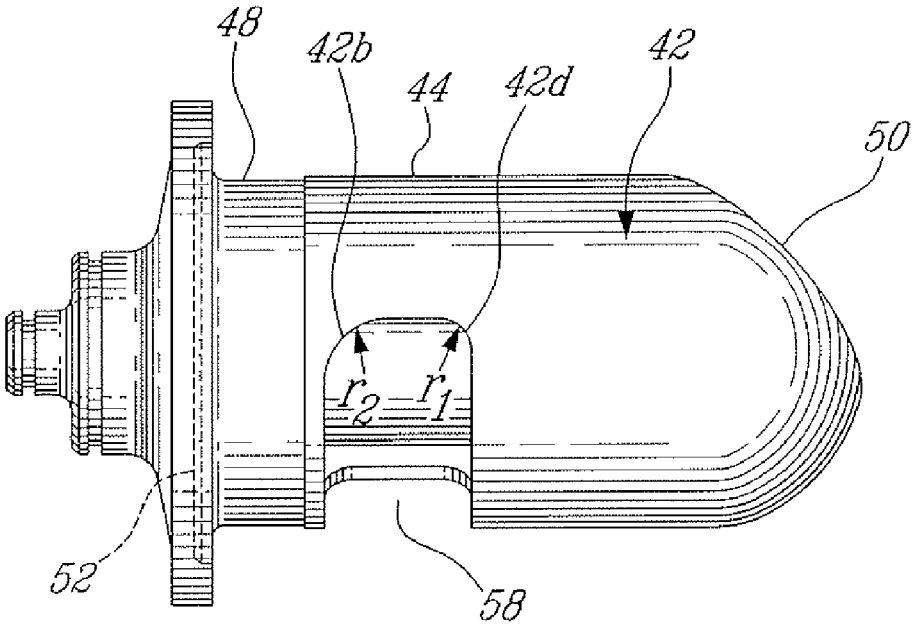
FIG. 4 is a side view of the fuel nozzle illustrating the radius difference between a top corner and a bottom corner of the window defined in the sheath.

The fuel nozzle 30 also comprises an open ended tubular sheath 42 having a sidewall 44 that surrounds the stem 32 defining an annular flow passage 46 therebetween. In addition of protecting the stein 32 from the hot combustion gases, the sheath 42 provides support to the combustor shell 24 axially and circumferentially while allowing relative radial movement to occur therebetween. As shown in FIGS. 3 and 4, the sheath sidewall 44 extends from an inlet end 48 to an outlet end 50. A mounting flange 52 is provided at the upper end of the sheath 42 for securing the sheath 42 to the undersurface of flange 34 of stem 32 by any appropriate means, such as by brazing or welding. Clipping means could also be used to detachably attach the sheath 42 in position about the stem 32. The sheath 42 is preferably of unitary construction and has a generally cylindrical shape which is angularly truncated at the outlet end 50 to define a slanted opening configured to accommodate the spray tip 40, as shown in FIG. 2. A lateral air supply window or opening 58 is defined in the sidewall 54 at the inlet end 48 of the sheath 42. As shown in FIG. 2, the opening 58 is disposed in the air flow path 20 in facing relationship with the incoming discharged compressor air.

The opening 58 connects the annular air flow passage 46 in fluid flow communication with the air flow path 20. According to the embodiment illustrated in FIGS. 3 and 4, the opening 58 has a generally elongated rectangular shape and extends about 50% of the circumference of the sheath 52. The window width is generally comprised in a range of about 35% to about 41% of the circumference of the sheath 42. The window 58 has a width to height ratio in the range of 2.1 to 2.5.

The presence of such a relatively large window in the sheath 42 makes it vulnerable to high stress and might result in large sheath deflection. Large sheath deformations are to be avoided since they can potentially result in load transfer from the combustor shell 24 to the stem 32, thereby reducing the fatigue life of the stem 32. Sheath deflection should also be avoided in order to minimize contact stress and prevent fretting damages between the sheath 42 and the stem 32. Accordingly, stress concentration in the sheath 42 is to be avoided.

Applicants have found through analytical methods, such as finite elements, and testing procedures that the window top corner 42*b* is subject to higher stresses than the other corners 42*a*, 42*c* and 42*d* and as such is more likely to give rise to sheath deflection. It is herein proposed to reduce the stresses in the top corner 42*b* by increasing stresses in the other corners 42*a*, 42*c* and 42*d* where the level of stress has been identified as being lower. This can be achieved by increasing the corner radius in corner 42*b* and reducing the radii of the other corners 42*a*, 42*c* and 42*d*. Reducing the corner radius at corners 42*a*, 42*c* and 42*d* has for effect of increasing the level of stress thereat. Conversely, by increasing the corner radius of corner 42*b*, the stress thereat is reduced. This provides for a more uniform distribution of the stress along the window perimeter.

According to one embodiment, the corners 42*a*, 42*c* and 42*d* have a corner radius r1 equal to 0.090", whereas corner 42*b* has a corner radius r2 equal to 0.180" that is two times greater than radius r1. It is understood that other r1/r2 ratios could be used as well to smooth out the stress distribution about the window 58. For instance, the ratio r2/r1 could be comprised between about 1.5 to about 2.0.

In use, the sheath 42 supports the combustor shell 24 axially and circumferentially while providing freedom of movement in the radial direction. As shown in FIG. 2 the aperture 58 in the tubular sheath 52 faces the air flow path 20 so as to intake oncoming compressor discharged air. The sheath 52 with its window 58 captures the dynamic head that is imposed by the incoming compressor air. The captured air flows along the annular air passage 46 towards the spray tip 40 coupled to the outlet end 50 of the sheath 52. The air is ejected into the primary combustion zone 26 through air openings defined in the spray tip 40 in order to atomize the fuel delivered through the stem 32. The selected increased and reduced corner radius r2 and r1 ensure proper stress distribution in the sheath 42, thereby preventing combustor load transfer on the nozzle stem 32 through the sheath 42 during normal engine operations.

The above description is meant to be exemplary only, and one skilled in the art will recognize that changes may be made to the embodiments described without department from the scope of the invention disclosed. For example, the sheath 42 could have a different configuration than the one shown and herein described. The shape of the sheath is not limited to cylindrical and the term "cylindrical" should be herein broadly construed. It should also be understood that the tubular sheath may be attached to the fuel adapter and spray tip assembly in many different ways. The window does not necessarily have to be rectangular. Other shapes are contemplated as well as long as they provide adequate air supply to the fuel nozzle. Still other modifications which fall within the scope of the present invention will be apparent to those skilled in the art, in light of a review of this disclosure, and such modifications are intended to fall within the appended claims.

The invention claimed is:

1. A fuel nozzle sheath adapted to be mounted about a gas turbine engine fuel nozzle stem having a spray tip, the sheath comprising a tubular body having a perimeter and extending longitudinally from a first end to an opposite second end, the first end surrounds an inlet portion of the fuel nozzle stem while the second end surrounds the spray tip, and a lateral opening defined through the tubular body and extending longitudinally along at least a portion of said perimeter, said lateral opening being bounded by a top edge, a bottom edge and two side edges, the lateral opening having top rounded inside corners at the junctions of the side edges and the top edge, and bottom rounded inside corners at the junctions of said side edges and the bottom edge, the radius of at least one of said top rounded inside corners being larger than the radii of the bottom rounded inside corners when projected in a same plane.

2. The fuel nozzle sheath of claim 1, wherein said at least one corner is known to be exposed to higher stresses than the other rounded inside corners of the lateral opening during use.

3. The fuel nozzle sheath of claim 1, wherein the radius of said at least one top rounded inside corner is about two times greater than the radii of the other rounded inside corners.

4. The fuel nozzle sheath of claim 1, wherein only one of the top rounded inside corners has a radius larger than the other rounded inside corners.

5. The fuel nozzle sheath of claim 1, wherein the top rounded inside corners are located at a first distance from an edge of said first end, the bottom rounded inside corners being corners located at a second distance from said edge of said inlet end, the first distance being smaller than the second distance.

6. The fuel nozzle sheath of claim 1, wherein said lateral opening has a generally rectangular configuration, and wherein the lateral opening extends along about half of the perimeter of the tubular body.

7. The fuel nozzle sheath of claim 1, wherein out of the four rounded inside corners, three have a radius R1 and one of the top rounded inside corners has a radius R2, and wherein R2/R1 is comprised between about 1.5 to about 2.0.

8. The fuel nozzle sheath of claim 1, wherein said lateral opening has a width comprised in a range of about 35% to about 50% of the perimeter of the tubular body.

9. A gas turbine engine fuel nozzle comprising: a fuel conveying member defining at least one fuel passage, a spray tip connected in fluid flow communication with said at least one fuel passage, said spray tip having an air discharged openings, a sheath provided about said fuel conveying member, an air passage defined between said fuel conveying member and said sheath, said air passage leading to said air discharged openings, a window defined in said sheath for supplying air to said air passage, said window being circumscribed by a top edge, a bottom edge, and first and second side edges, the window having first and second top rounded inside corners defined at a junction of the top edge and the first and second side edges respectively, the window further having first and second bottom rounded inside corners defined at a junction of the bottom edge and the first and second side edges, respectively, at least one of the first and second top and bottom rounded inside corners presenting a stress concentration which is greater than that of other rounded inside corners of the window, and wherein said stress concentration is smoothed out by increasing a radius of curvature of said at least one inside radius corner relative to a radius of the other corners as measured when projected in a same plane.

10. The fuel nozzle as defined in claim 9, wherein the window is defined about a portion of a circumference of the sheath and has two opposed ends, said increased radius of curvature being provided at only one of said opposed ends.

11. The fuel nozzle as defined in claim 10, wherein only one of said first and second top and bottom rounded inside corners has a greater radius of curvature than the others.

12. The fuel nozzle as defined in claim 11, wherein the first and second top rounded inside corners are located closer to the spray tip than the first and second bottom rounded inside corners, and wherein said increased radius of curvature is provided at one of said first and second to rounded inside corners.

13. The fuel nozzle as defined in claim 9, wherein the window has a generally rectangular shape and extends about a portion of the circumference of the sheath, only one of the top and bottom rounded inside corners having a radius larger than the other corners.

14. The fuel nozzle as defined in claim 9, wherein the increased radius is about two times greater than the radius of other rounded inside corners of the window.

* * * * *